US005259524A

United States Patent [19]

Eckert

[11] Patent Number: 5,259,524

[45] Date of Patent: Nov. 9, 1993

[54] SYSTEM AND DEVICE FOR STABILIZING AND HOLDING DRUMS DURING TRANSPORT

[75] Inventor: Robert L. Eckert, Los Alamitos, Calif.

[73] Assignee: Robert L. Eckert Trust, Los Alamitos, Calif.

[21] Appl. No.: 927,155

[22] Filed: Aug. 7, 1992

[51] Int. Cl.[5] ..... B65D 71/50

[52] U.S. Cl. ..... 220/23.4; 206/446; 206/597; 206/814

[58] Field of Search ..... 108/55.1, 55.3, 55.5; 206/386, 446, 595-600, 814; 211/71; 220/23.4

[56] References Cited

U.S. PATENT DOCUMENTS

| | | | |
|---|---|---|---|
| 2,702,641 | 2/1955 | Arthur | 220/23.4 |
| 2,810,171 | 10/1957 | Brooks et al. | 220/23.4 |
| 3,004,746 | 10/1961 | Swingle . | |
| 3,062,373 | 11/1962 | Reynolds | 206/497 |
| 3,065,857 | 11/1962 | Sanders | 211/71 |
| 3,217,892 | 11/1965 | Goodell . | |
| 3,388,792 | 6/1968 | Jones . | |
| 3,942,670 | 3/1976 | Mingus et al. | 220/23.4 |
| 4,061,391 | 12/1977 | Violette . | |
| 4,403,556 | 9/1983 | Van Gompel | 108/55.3 |
| 4,529,345 | 7/1985 | Van Gompel . | |
| 4,564,109 | 1/1986 | Stavlo | 206/597 |
| 4,730,732 | 3/1988 | Wagonseller . | |
| 5,144,897 | 9/1992 | Avery | 108/55.3 |

*Primary Examiner*—Jimmy G. Foster
*Attorney, Agent, or Firm*—Robert D. Buyan

[57] ABSTRACT

A device, system and method for preventing unwanted movement or shifting of drums or containers stored in groups of two or more. A core member is positioned intermediate, among or between the drums or containers and at least one pressure exerting member or strap is utilized to urge the drums or containers inwardly into direct abutment with the core member. The core member may be specifically configured such that the individual drums or containers will nest or seat firmly against the core member. The pressure-exerting member may comprise any suitable type of pressure-exerting apparatus or article including strap(s), band(s), plastic shrink wrapping, cable, chains, etc. . . . The core member may be formed in multiple segments or may be specifically configured to accommodate tapered, angled or odd shaped drums or containers having sidewalls which are not perfectly vertical. One or more holding members may extend from the core member to rest upon the top edges of the drums or containers, thereby holding the core member in a desired vertical position amidst intermediate, among or between the drums or containers. The positioning member(s) may be upwardly and downwardly adjustable so as to render the device useable with groups of drums or containers of differing height.

29 Claims, 6 Drawing Sheets

SYSTEM AND DEVICE FOR STABILIZING AND HOLDING DRUMS DURING TRANSPORT

FIELD OF THE INVENTION

The present invention relates generally to materials handling equipment and more particularly to a system and device for holding groups of containers or drums in substantially fixed position relative to one another so as to prevent lateral movement or shifting of the drums during transportation and handling.

BACKGROUND OF THE INVENTION

Containers, such as chemical drums, sometimes undergo lateral movement (e.g., sliding, shifting or "walking") during handling and transport. Such lateral movement of containers or drums may result in damage to and/or leakage from such containers or drums. Such leakage from the containers or drums is particularly problematic when the containers or drums contain chemical substances which are hazardous, toxic, expensive or explosive. Also, shifting or movement of containers or drums may result in toppling or falling of the containers or drums from an underlying pallet or support platform.

Thus, it is desirable to devise methods and/or devices for preventing lateral movement, sliding, shifting or walking of containers, such as chemical drums, during transportation and handling.

Various prior devices have been described for securing or holding containers, such as chemical drums, during transportation and handling. Examples of such prior devices are described in U.S. Pat. Nos. 4,730,732 (Wagonseller), 4,061,391 (Vilolette), 3,388,792 (Jones), 3,004,746 (Swingle), 4,529,345 (Van Gompel) and 3,217,892 (Godell).

In addition to the devices described in the above-listed prior United States patents, it has been common practice in the art to utilize straps, bands, and/or plastic wrapping materials to secure and hold groups of drums shipped on pallets. For example, it is common practice to ship a quartet of four (4) chemical drums in two-by-two side by side rectangular configuration on a generally rectangular shipping pallet. With said quartet of drums so positioned on the shipping pallet, it is common practice to wrap a plastic or metal band around the outside of the drums and/or to apply plastic shrink wrap material to the drums in an effort to hold the drums in position on the pallet and to prevent the drums from shifting, moving or dropping from the pallet during transport while such banding or plastic shrink wrapping around the drums may, in some instances, serve to hold the drums on the pallet, it typically does not prevent the drums from shifting or walking relative to one another over the surface of the pallet.

Thus, there remains a need in the art for improved systems and devices for securely holding groups of containers, such as chemical drums, in substantially fixed position on a horizontal underlying surface, such as a shipping pallet.

SUMMARY OF THE INVENTION

The present invention overcomes shortcomings of the prior art by providing a simple system and device for holding containers, such as chemical drums, in substantially fixed position relative to one another on an underlying horizontal support surface such as a pallet, deck of a ship, floor of a truck trailer, floor of a cargo container, etc.

In basic form, the invention comprises a substantially rigid core member which is insertable intermediate or between a group of drums or containers. The core member is configured such that each of the drums or containers in the group may abut and press directly against the core member upon application of a clamping force or pressure upon the drums or containers to urge them inwardly against the core member. Such clamping force, or pressure may be provided by any suitable pressure exerting member or apparatus, including bands, straps, wrappings, cords or other members tightened about the group of drums or containers. The configuration of the core member is such that, when each drum or container in the group is held in pressing contact with the core member, said drums or containers will be thereby substantially prevented from undergoing lateral or side to side movement relative to one another. Core member configurations which achieve this function include those having generally arcuate cut-out regions or indentations formed on the core member, said cut-out regions or indentations being configurationally analogous to the side walls of the drums or other containers to be held.

In accordance with the invention, there is provided a core member or abutment member which is shaped to be positionable between or among a group of containers or drums. The specific shape or configuration of the core member may be varied depending on the number of drums or containers to be accommodated. In many applications, the core member will be sized and configured to accommodate a quarted to four (4) containers or drums stored in typical two-by-two, side-by-side position, as on a standard storage pallet. Other configurations may be utilized to store any other desired number of containers or drums.

Further in accordance with the invention, various positioning means or members, such as a top plate, flange, hooks, wires, brackets or tape may extend from the core member so as to register against or engage at least one of the drums in the group when the core member has been inserted to its optimal operative position between or intermediate the drums. Such positioning members preferably engage the top edges or lips of the drums so as to be easily accessible by the human hand, thereby facilitating grasping and removal of the core member from its operative position at the time of disassembly or unloading. One or more of the positioning members be slideably, moveably or adjustably attached to the core member so as to permit upward and downward movement of the positioning member in a manner that will enable the positioning member to accommodate varying heights of drums or containers. Thus, by providing one or more floating or adjustable positioning members, the device of the present invention may be utilized with groups of odd or unmatched drums having various sizes and configurations.

Further in accordance with the invention, the means by which the drums of the group are held in contact with or pressed against the core member may comprise any suitable pressure exerting member such as a band, strap, belt, rope, chain, cable or other member wrapped around the group of drums and tightened thereon so as to press the drums inwardly against the core member. In some embodiments of the invention, a dedicated strapping system or other pressure exerting member(s) may be directly attached to the core member so as to form a unitary device therewith. In other embodiments, the core member may comprise a separate device in and of itself, useable in connection with other pressure exerting members such as commonly used plastic bands, straps, plastic shrink wrap, and the like.

Further, in accordance with the invention, the core member positionable between or intermediate the drums of the group may comprise a primary or upper abutment body having one or more secondary or lower abutment bodies suspended or otherwise attached therebelow. In some embodiments, each of the primary and secondary abutment bodies may be of different size or configuration so as to firmly receive and abut against the drums of the group at the particular vertical location whereat each such abutment body is operatively located. The provision of primary and secondary abutment bodies of differing size and configuration is particularly applicable when the drums or containers in the group are tapered, bulged or otherwise provided with outer sidewalls having varied dimensions, diameters or configurations.

Further in accordance with the invention, the rigid core member may be formed of any suitable material capable of performing the function of the core member, including metal, wood, plastic, structural cardboard or fiberboard. The core member may be reusable or disposable. In embodiments which are disposable, it will generally be desirable to form the core member of relatively inexpensive materials such as structural cardboard or fiberboard. In embodiments which are returnable or reusable, it will generally be desirable to form the core member of strong material capable of withstanding repeated use, such as wood, molded plastic or metal.

Further objects and advantages of the invention will become apparent to those skilled in the art upon reading and understanding of the following detailed description and the accompanying drawings.

DETAILED DESCRIPTION OF THE PREFERRED EMBODIMENT

The detailed desoription set forth below in connection with the appended drawings is intended as a description of the presently preferred embodiments of the invention, and is not intended to represent the only forms in which the present invention may be constructed or utilized. The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Various embodiments of the drum holding device of the present invention are illustrated in FIGS. 1-28 which depict seven presently preferred embodiments of the invention.

A first embodiment of the invention generally comprises a core member 10*a* disposed intermediate four drums 100 and a strap or pressure exerting member (not shown) encircling the drums 100 and urging them inward toward the core member 10*a*. The core member 10*a* comprises a planar abutment member 12*a*, having at least one, preferably four, hooks or brackets 14*a* extending from the upper surface thereof such that they engage the upper surfaces or lips 101 of the drums 100. The planar member 12*a* has four cut-outs 26*a* formed therein and configured to receive portions of each drum 100. The planar positioning member 12*a* also has four extensions 24*a* extending therefrom such that they are disposed intermediate and separate adjacent drums 100.

Figure 3:
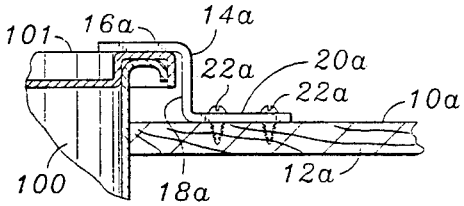
FIG. 3 is a sectional view through line 3—3 of FIG. 1.

With particular reference to FIG. 3, each hook or retaining bracket 14*a* is preferably comprised of 14 gauge steel configured to have a generally horizontal upper member 16*a*, a generally vertical intermediate member 18*a* connected thereto and a generally horizontal lower member 20*a* connected to the intermediate member 18*a*. Fasteners, preferably screws 22*a*, attach the hooks or brackets 14*a* to the planar member 12*a*. The hooks or brackets 14*a* are positioned such that they allow each drum 100 to abut its corresponding cutout 26*a*, thereby allowing the pressure exerting member or strap to draw the drums 100 inward tightly against the spacer 10*a*.

The pressure exerting member or strap may comprise a contemporary steel or plastic band or alternatively may comprise a nylon webbing or similar material having a buckle or ratchet cinch for effecting connection of the two ends thereof together and tightening thereof. The pressure exerting member or strap will preferably be positioned about the drums 100 between mid-height and the tops thereof such that the drums 100 are urged inward toward the core member. Thus, tightening of the buckle or ratchet cinch causes the drums 100 to firmly abut the cutouts 26*a* of the core member 10*a* such that all four drums 100 may be handled as a single unit. That is, the drums 100 may be picked up, transported, set down, and stored together without concern that one or more drums 100 may become inadvertently separated from the remaining drums 100.

Figure 1:
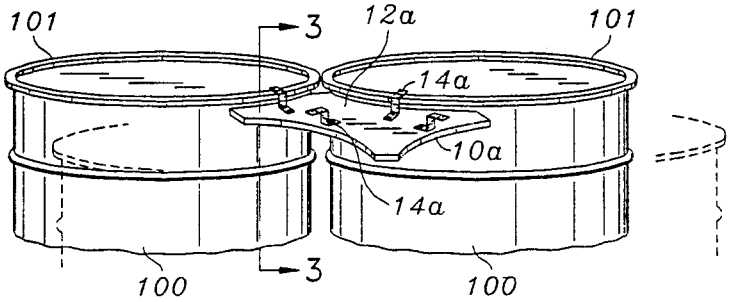
FIG. 1 is a perspective view of a rigid core member in accordance with the invention positioned between or intermediate a quartet of four (4) drums positioned in two-by-two side by side configuration.
Figure 2:
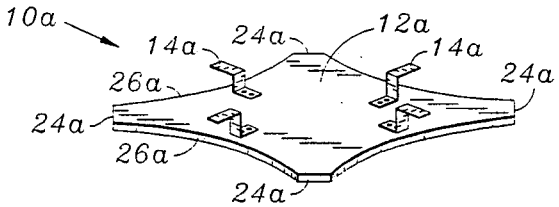
FIG. 2 is an enlarged perspective view of the rigid core member shown in FIG. 1.

Having thus described the structure of the first embodiment of the drum holding device of the present invention, it may be beneficial to describe the operation thereof. Generally, four drums 100 will be positioned upon a pallet and configured as illustrated in FIG. 1, wherein the centers of the drums 100 generally define a square. A small space is preferably left between adjacent drums 100 to facilitate easy insertion of the core member 10*a* therebetween. The core member 10*a* is inserted intermediate the four drums 100 such that each cutout 26*a* receives a portion of one drum 100 therein and each extension 24*a* extends between two adjacent drums 100. The hook or bracket 14*a* rests upon the upper peripheral surface or lip of each drum 100 such that the core member 10*a* is supported at a height of between one and ten inches, preferably approximately two inches, below the upper surface of the drums 100.

With the core member 10*a* so positioned, the pressure exerting member or strap is wrapped about the four drums 100 between approximately one-half the height and the full height thereof. Tightening the belt or ratchet cinch draws the drums 100 inward such that they firmly abut the cutouts 26 of the core member 10*a*, thereby facilitating conventional manipulation of the drums 100 as a single unit.

Figure 4:
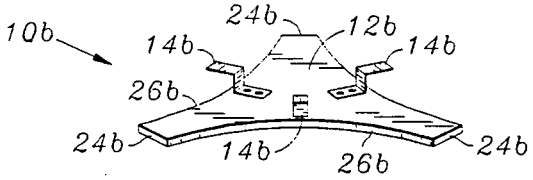
FIG. 4 is a perspective view of a rigid core member in accordance with the invention configured for use with a group of three (3) drums.

Referring now to FIG. 4, a core member 10*b* according to a second embodiment of the drum holding device of the present invention is similar in construction to that of the first embodiment. In the second embodiment, the core member is configured to have three cutouts 26*b* and three extensions 24*b* such that it accommodates three drums 100 rather than four. Those skilled in the art will recognize that various other embodiments of the core member may be similarly configured to receive various other numbers of drums or the like.

The core member according to a second embodiment of the drum holding device of the present invention is utilized in an analogous manner to that of the first embodiment. Use of the second embodiment of the drum holding device of the present invention results in three drums 100 being firmly joined together such that they may be conveniently manipulated as a unit.

Figure 5:
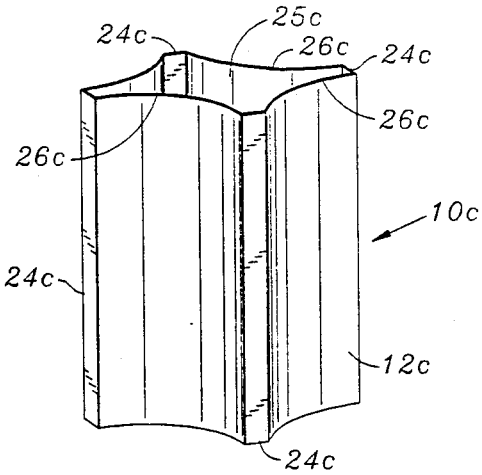
FIG. 5 is a perspective view of an alternative configuration of a rigid core member in accordance with the invention.

Referring now to FIG. 5, a core member 10*c* according to a third embodiment of the drum holding device of the present invention comprises an elongate, possibly hollow or solid, member 10*c* having cutouts 26*c* and extensions 24*c* formed therein such that the spacer 10*c* may be disposed intermediate four drums 100 such that a drum 100 is received within each cutout 26*c* and such that an extension 24*c* extends between adjacent drums 100. A bore or channel 25*c* extending longitudinally through the elongate member 10*c* reduces the weight thereof, thus lowering manufacturing costs and facilitating convenient handling thereof.

Figure 6:
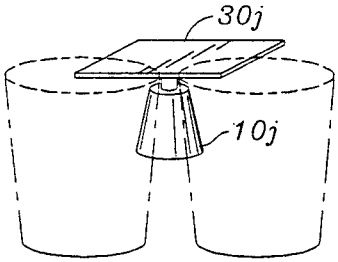
FIG. 6 is a perspective view of an alternative embodiment of a device of the present invention wherein the rigid core member is of generally frustoconical configuration so as to abut against angularly tapered sidewalls of a plurality of tapered containers or drums.

The core member 10 may be specifically configured to accommodate varying sizes and shapes of drums or containers. As shown in FIG. 6, some commercially available drums have tapered or angled sidewalls, or tapered or angled sidewall portions, such that the top of the drum is of a larger diameter than the bottom of the drum. Examples of such tapered drums are those commercially available through Sonoco Rastic Drum, Lombard, IL/Lockport, Ill. In such embodiments, the core member 10*j* may be of an angularly divergent, generally conical or generally frustoconical pyramidal, frustopyramidal, or other tapered configuration so as to comply with and abut firmly against the angled or tapered sidewall of the angled or tapered drums. In the embodiment shown in FIG. 6, the generally frustoconical core member 10*j* is attached to and extends downwardly from a top plate member 30*j*. In alternative embodiments, the core member may comprise an upstanding conical, frustoconical or angularly convergent member extending upwardly from the base of the drums, as opposed to the embodiment shown wherein the core member 10j hangs downwardly from an upper plate member 30j. In embodiments wherein the core member 10j is specifically configured to correspond to the shape or angular divergence of the sidewalls of the containers or drums, the core member may be formed of substantially rigid material such as molded thermoplastic as compression of the core member will be substantially unnecessary due to the fact that the core member complies and corresponds directly with the configuration of the drum or container sidewalls.

In some embodiments, the core member 10 may optionally be formed of a resilient or compressable material, such as a flexible polymer foam. The use of such a resilient or compressable material permits the core member 10 to conform substantially to the shape of the drums 100 between which it is inserted, thus allowing the core member to accommodate a wider variety of drum shapes and configurations.

Figure 8:
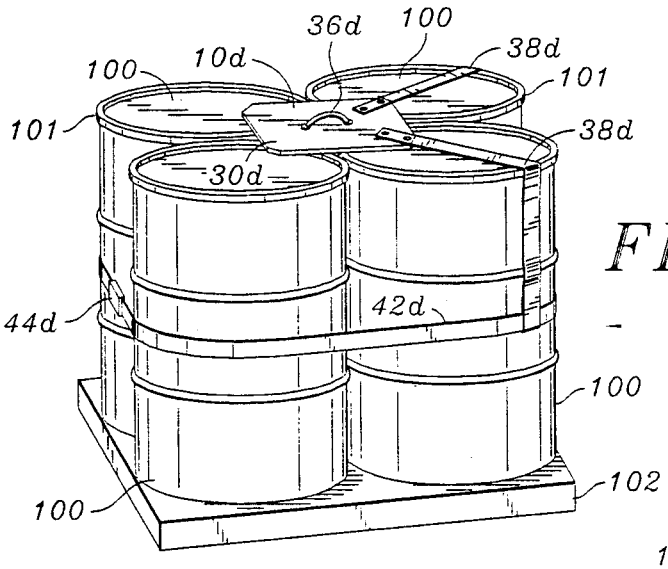
FIG. 8 is a perspective showing of a quartet of four (4) chemical drums positioned in two-by-two side by side configuration on a rectangular shipping pallet and having the device of FIG. 7*a* operatively deployed thereon.
Figure 10:
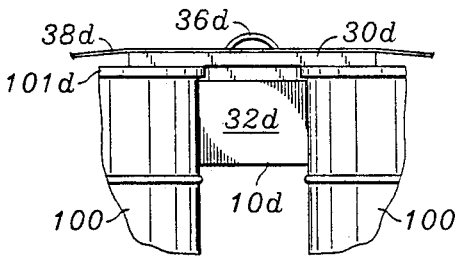
FIG. 10 is a sectional view through line ten (10) of FIG. 9.

The embodiment shown in FIG. 5 may be used with a quartet of four (4) drums such as that shown in FIG. 8. In such application of the device of FIG. 5, the core member 10c is inserted intermediate the four drums 100 such that the lower end thereof rests upon the upper surface of the pallet. The upper end of the core member 10c is preferably of sufficient height that it is disposed at a height greater than one-half the height of the drums 100 when the lower end thereof rests upon the pallet. A pressure exerting member or strap is positioned about the drums 100, preferably such that its height is approximate that of the upper end of the elongate member 10c. Tightening the pressure exerting member or strap draws a drum 100 into each of the recesses 26c such that the drums 100 may be manipulated as a single unit.

Figure 9:
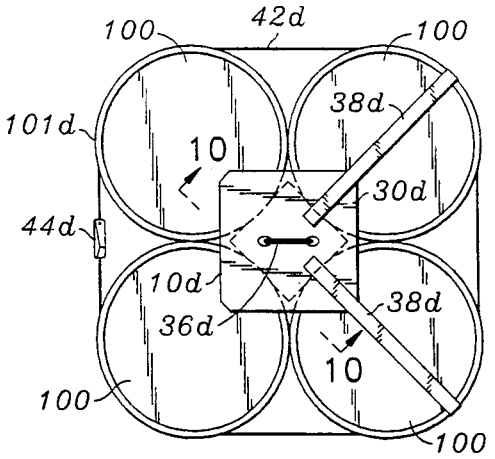
FIG. 9 is a top plan view of a quartet of four (4) drums in two-by-two side by side configuration having the device of FIG. 7*a* operatively deployed thereon.
Figure 11:
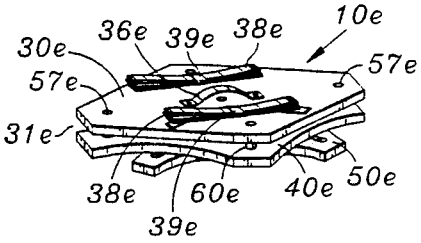
FIG. 11 is a perspective view of an alternative embodiment of a device of the present invention disposed in a collapsed, non-operative configuration.
Figure 12:
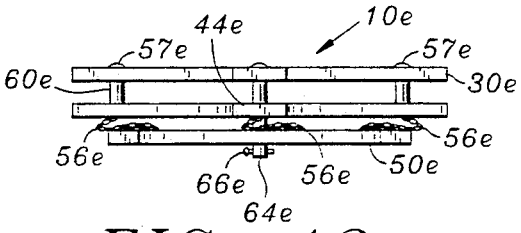
FIG. 12 is an elevational side view of the spacer of FIG. 11.
Figure 13:
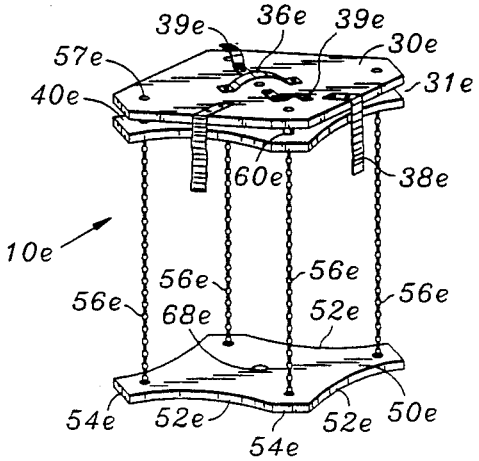
FIG. 13 is a perspective of the device of FIG. 11 disposed in its non-collapsed operative configuration.

Referring now to FIGS. 7–9, there is shown an alternative embodiment of the present invention comprising a core member 10d and a pressure exerting member or first strap 42d, as well as a plurality of, and preferably two, second straps 38d. The second straps 38d are preferably attached to the core member 10d via fasteners 40d, preferably screws. The two second straps 38d are preferably sewn to the first strap 42d. Those skilled in the art will recognize that various other means, i.e. velcro, hooks, buttons, buckles, etc., are likewise suitable for attaching the first strap 42d to the second straps 38d. The first strap 42d may be fixedly attached to the second straps 38d or may optionally be adjustable attached thereto such that the height of the first strap 42d about the drums 100 may be adjusted.

Figure 7A:
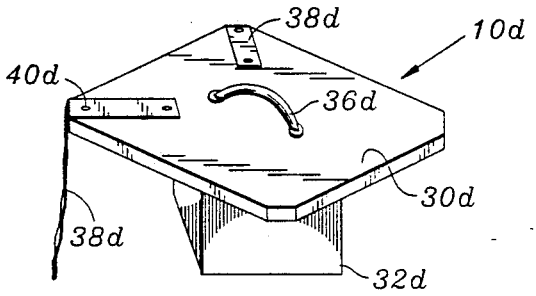
FIG. 7*a* is a top perspective view of the device of the present invention wherein the rigid core member is provided with a top plate positioning member and wherein a dedicated pressure exerting strap system is attached directly to the rigid core member.
Figure 7B:
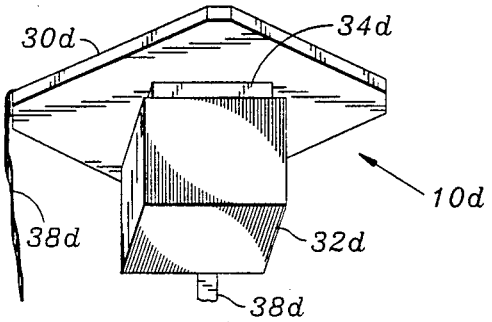
FIG. 7*b* is a bottom perspective view of the device shown in FIG. 7*a*.

With particular reference to FIGS. 7a and 7b, the core member 10d of the embodiment shown therein comprises a support member 30d, preferably configured in a substantially planar fashion, having a separation member 32d, preferably configured as a block, depending downwardly therefrom. A handle 36d may optionally be formed atop the core member 10d such that the core member 10d may be conveniently carried and manipulated thereby.

A recess or groove 34d is formed at the base of the abutment member 32d, where the abutment member 32d contacts the support member 30d, such that the lip 101 of each drum 100 is received thereby when the spacer 10d is operatively disposed.

With particular reference to FIGS. 8 and 9, the pressure exerting member or first strap 42d is disposed about four drums 100 and is attached to second straps 38d such that the first strap 42d is supported thereby during the installation process as described in detail below. Buckle or ratchet cinch 44d, a commercially available product, is attached at the ends of the first strap 42d such that the first strap 42d may be tightly secured about the drums 100 which rest upon pallet 102. Buckle or ratchet cinch 44d is preferably of a type which provides maximum adjustability of the first strap 42d by allowing various lengths of one end of the first strap 42d to be fed therethrough, and the strap then tightened and locked into position. One example of such a buckle or ratchet cinch is that disclosed in U.S. Pat. No. 4,185,360 issued to Prete, Jr., et al. on Jan. 29, 1980. Those skilled in the art will recognize that various buckles, hook and loop fastening means, etc., are likewise suitable.

To use the drum holding device of the fourth embodiment of the present invention, four drums 100 are positioned atop a pallet 102 such that their centers generally define a square. A core member 10d of the fourth embodiment of the present invention is installed such that the block-like separation member 32d thereof is disposed intermediate the upper portions of the four drums 100 and the planar positioning member 30d of the core member 10d rests upon the upper surfaces or lips 101 of the drums 100.

The second straps 38d are laid across the tops of two adjacent drums 100 and downward along the sides thereof such that they support a portion of the first strap 42d. The ends of the first strap 42d may then be attached together utilizing the buckle or ratchet cinch 44d and the first strap 42d tightened such that the drums 100 are urged inward, toward the core member 10d.

Referring now to FIGS. 11–16, a fifth embodiment of the drum holding device of the present invention is particularly suited for restraining drums 100 or other items having sloped or non-parallel sides wherein the distance between adjacent items varies with height. That is, the adjacent drums or items may be closer to each other at the middle than at the top or bottom thereof, for example. Thus, in the fifth embodiment of the present invention a pendulous lower or second separation member 30e is positioned inferior to an upper or first separation member 40e. The first 40e and second 50e abutment members are preferably configured in a substantially identical planar fashion and preferably have recesses 42e and 52e, respectively, formed therein for receiving portions of the drums 100 or other items being secured thereby. The first 40e and second 50e separation members likewise have extensions 44e and 54e, respectively, extending therefrom and separating adjacent drums 100. The second separation member 50e preferably depends from the first abutment member 40e via flexible tether such as a chain, rope, string, cord, cable, wire or other suitable member.

In the fifth embodiment of the drum holding device of the present invention, the support member 30e and the first separation member 40e are preferably configured as substantially parallel planar members separated apart from one another by a distance sufficient to form a recess or groove 31e therebetween for receiving the upper lip 101 of each drum 100.

The second straps 38e are preferably of sufficient length that the first strap 42e is positionable about the drums 100 at a height approximate to that of the second separation member 50e, i.e., approximately one-half the height of the drums 100.

The support member 30e and the first separation member 40e may be positioned relative to one another via core members 60e each having a fastener 30e, i.e. a bolt, passing therethrough. The second straps 38*e* can preferably be disposed in a folded fashion atop the core member 10*b* and secured thereupon via third or fastening straps 39*e*. Fastening straps 39*e* preferably utilize hook and loop fasteners to facilitate their being secured about the second straps 38*e*. Those skilled in the art will recognize that various other attaching means, i.e. buckles, buttons, etc., are likewise suitable. The fastening straps 39*e* may optionally also be utilized to stow the first strap 42*e*.

Figure 15:
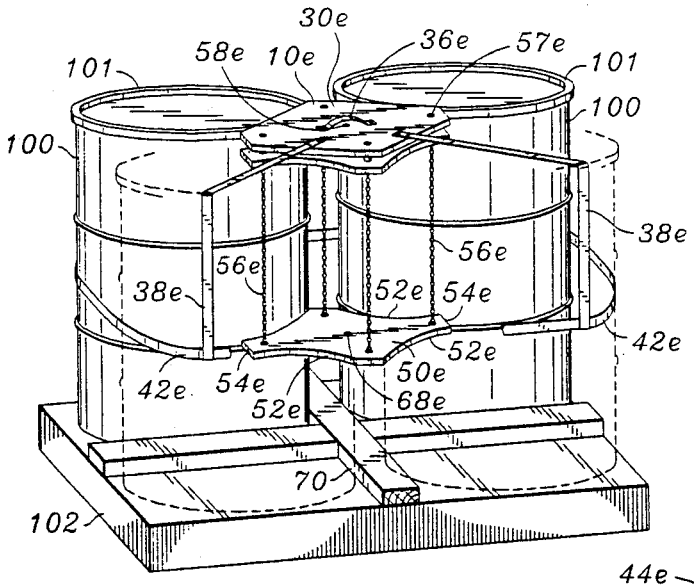
FIG. 15 is a perspective showing of a quartet of four (4) drums positioned in two-by-two side by side configuration on a shipping pallet and having the device of FIG. 11 operatively deployed thereon.
Figure 16:
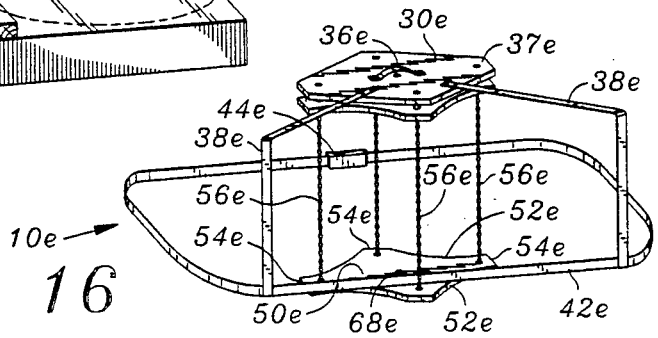
FIG. 16 is a perspective view of the device of FIG. 11 in its non-collapsed operatively deployed configuration with the pressure exerting straps of the device fully expanded as to be positioned around a plurality of containers or drums.

With particular reference to FIG. 15, optional drum positioning rails or members 70 may be formed upon the upper surface of the pallet 102 or other underlying horizontal support surface to prevent the drums 100 or other items positioned thereupon from sliding. Such positioning rails or members 70 are preferably formed as a cross, i.e., having two intersecting 16 members. Those skilled in the art will recognize that the positioning rails of member 70 may be variously configured, i.e. as raised circular ridges about the bottoms of the drums 100, etc. The restraining member 70 may be utilized with any embodiment of the present invention.

Figure 14:
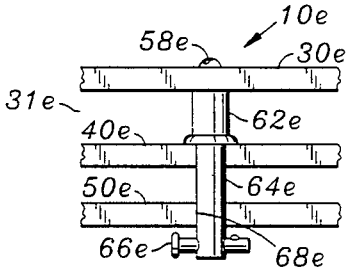
FIG. 14 is an enlarged cut-a-way side elevational view of a portion of the device of FIG. 11 disposed in its collapsed non-operative configuration.

With particular reference to FIG. 14, the lower separation member 50*e* may optionally be removably attached to the upper separation member 40*e* to facilitate convenient storage and transportation of the drum holding device of the fifth embodiment of the present invention when not in use. Such attachment is preferably via pin 64*e* extending from spacer 62*e* through first separation member 40*e* and then being received by aperture 68*e* of the lower separation member 50*e*. Looking pin 66*e* is received through pin 64*e* to secure the second separation member 50*e* thereupon. Securing the lower separation member 50*e* to the upper separation member 40*e* results in the configuration illustrated in FIGS. 11 and 12 wherein the lower separation member 50*e* is in laminar juxtaposition to the upper separation member 40*e* and the flexible members or chains 56*e* are disposed intermediate the second separation member 50*e* and the first separation member 40*e*. Core member 62*e* disposed intermediate the first separation member 40*e* and the planar support 30*e* is preferably secured therebetween via fastener or screw 58*e*. Those skilled in the art will recognize that various other means for detachably attaching the lower separation member 50*e* to the upper separation 40*e* are likewise suitable.

The fifth embodiment of the drum holding device of the present invention is utilized by first positioning four drums 100 upon a pallet 102 such that they almost abut and are separated by restraining member 70. The core member 10*e* is positioned intermediate the drums 100 by first inserting the lower abutment member 50*e* portion of the core member 10*e* downwardly between the drums 100 to a point where the positioning member or top plate member 30*e* rests atop the drums 100 such that it is supported by the upper surface or lip 101 thereof and such that the first abutment member 40*e* is prevented thereby from extending further downward intermediate the drums 100.

The second straps 38*e* are extended across the tops and downward along the sides of two drums 100 such that they support a portion of the first strap 42*e*. The ends of the first strap 42*e* are attached together via buckle or ratchet cinch 44*e*. The first strap 42*e* is tightened, thus urging the drums 100 inward such they abut the cutouts 42*e* and 52*e* of the first 40*e* and second 50*e* separation members, respectively. The lips 101 of the drums 100 are received within the groove 31*e* formed intermediate the positioning member 30*e* and the first separation member 40*e*.

Figure 17:
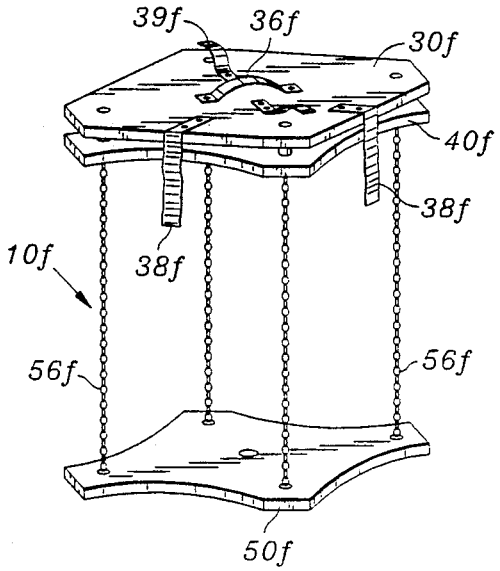
FIG. 17 is a perspective view of an alternative embodiment of a device of the present invention.
Figure 18:
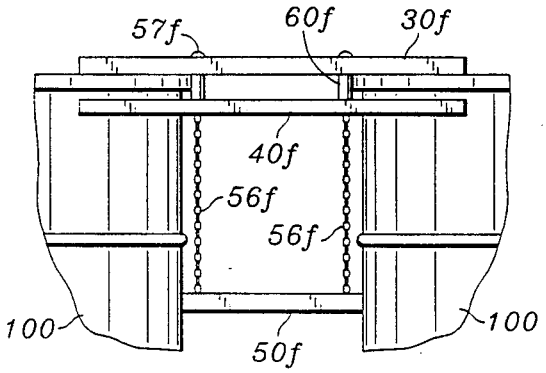
FIG. 18 is a side elevational view of a plurality of chemical drums having the device of FIG. 17 operatively deployed in relation thereto.

Referring now to FIGS. 17 and 18, a sixth embodiment of the drum holding device of the present invention having an alternative configuration of the second separation member 50*f* is illustrated. In this alternative configuration, no recesses or extensions are formed in the lower separation member 50*f* and the lower separation member 50*f* is configured such that it tightly fits between adjacent drums 100 when inserted therebetween.

The sixth embodiment of the drum holding device of the present invention is utilized in an analogous manner to that of the fifth embodiment thereof. Lacking the cutouts of the fifth embodiment, the second separation member 50*f* of the sixth embodiment of the present invention provides a more generic interface, thereby facilitating use with drums 100 or other items of more widely varying configurations.

Figure 19:
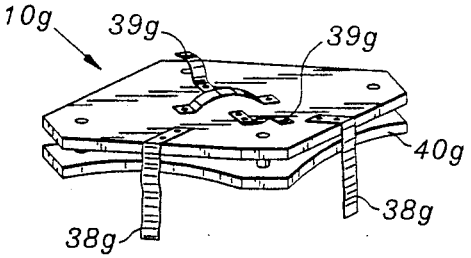
FIG. 19 is a perspective view of an alternative embodiment of a device of the present invention.
Figure 20:
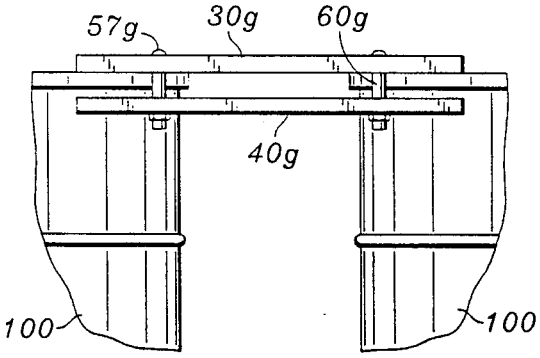
FIG. 20 is a partial side elevational view of the device of FIG. 19 operatively deployed in relation to a plurality of chemical drums.

Referring now to FIGS. 19 and 20, a seventh embodiment of the drum holding device of the present invention having an alternative configuration of the spacer 10*g* is illustrated. In this alternative configuration, the spacer 10*g* is configured the same as that illustrated in FIGS. 11–16 and 17–18 except that no second or lower separation member is utilized.

The seventh embodiment of the drum holding device of the present invention is utilized in a manner analogous to that of the fifth and sixth embodiments thereof except that a lower or second separation member need not be inserted intermediate the drums 100 prior to positioning the support member 30*f* upon the drums 100. Elimination of the second separation member in the seventh embodiment of the present invention facilitates its use with a wider variety of drums 100 or other items since the configuration of the items below the upper surfaces thereof need not conform to the configuration of a particular second separation member.

Figure 21:
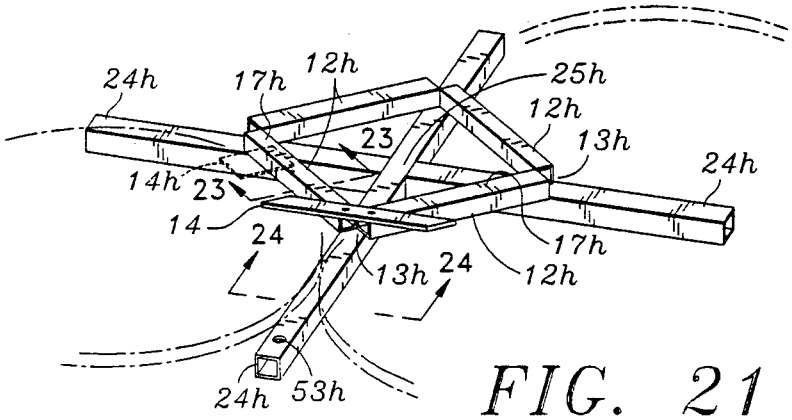
FIG. 21 is a perspective view of the device of the present invention wherein two cross members are attached to a square frame which depends from the upper lips of the drums by angle brackets or hooks.

Referring now to FIGS. 21–25, an eighth embodiment of the drum holding device of the present invention having a framework structure is illustrated. With particular reference to FIG. 21, the eighth embodiment of the drum holding device generally comprises crossed elongate members 24H attached to a generally square framework of shorter elongate members 12H and configured to be disposed intermediate for drums.

One or more positioning members 14 may be formed on or attached to the core member 10 for purposes of holding or supporting the core member 10 at a desired vertical height amidst, between or among the drums or containers.

Alternative types of positioning member(s) 14 may include angle brackets such as those shown in FIGS. 1, 3, 4, 21 (dotted lines) and 23 (dotted lines), or a flat plate, or other members as appropriate.

Figure 23:
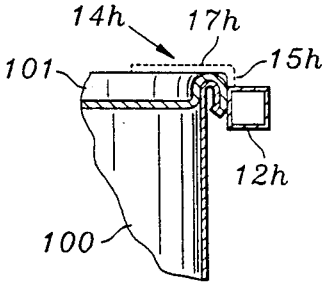
FIG. 23 is an enlarged cross-sectional view through line 23—23 of FIG. 22, showing an alternative angle bracket positioning member in dotted lines.

As shown in FIGS. 21 and 23, a flat bar member 14 (FB) may be attached to the top of the core member to abut against and rest on the tops of the drums 100, thereby preventing the core member from falling or dropping vertically downward amidst the drums 100.

Figure 21A:
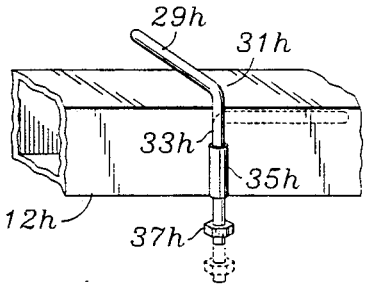
FIG. 21*a* is a perspective view of a portion of the rectangular frame having a stowable wire hanger replacing the angle bracket.

With particular reference to FIG. 21*a*, in an alternative arrangement the positioning member may comprise one or more a wire support 31*h* substituted for, or in addition to, a bracket bar or plate 14. The wire support 31*h* generally comprises elongate horizontal member 29*h* and elongate vertical member 33*h* formed perpendicular thereto. Vertical member 33*h* is received within sleeve 35*h* formed upon short elongate member 12*h*.

Nut 37*h*, preferably of a press-on type, secures wire support 31*h* within the sleeve 35*h*.

Wire support 31*h* is disposable in an operative position wherein horizontal member 29*h* extends perpendicular from short elongate member 12*h* in a fashion similar to that of the angle bracket 14*h* to effect suspension of the drum holding device from the lips 101 of adjacent drums 100.

The wire support 31*h* additionally has a stowed position wherein it is placed parallel to the short horizontal member 12*h* and lowered lightly so that it does not extend above the upper surface of the horizontal member 12*h*, thereby facilitating stacking of a plurality of drum quartets, one atop another. By placing the wire supports 31*h* in such a stowed position, they do not interfere with the stacking process, i.e., they are not disposed intermediate adjacent quartets.

Figure 24:
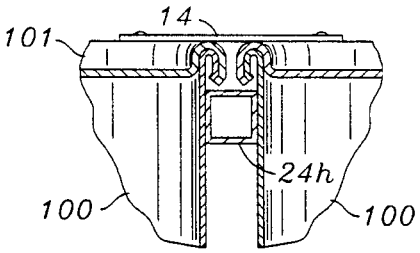
FIG. 24 is a cross-sectional sideview showing positioning of one of the cross members intermediate two drums.

With particular reference to FIG. 24, when installed, each crossed elongate member 24*h* extends intermediate two adjacent drums 100, thereby positioning the drums 100 in a spaced apart relationship. It should be noted that the framework drum holding device of the eighth embodiment of the present invention is particularly suitable for use with a quartet of drums wherein each drum is not of the same diameter. Those drums having smaller diameters are merely positioned closer to the center of the drum holding device, maintaining tangency to adjacent crossed elongate members 24H to facilitate proper positioning of the drum.

Figure 22:
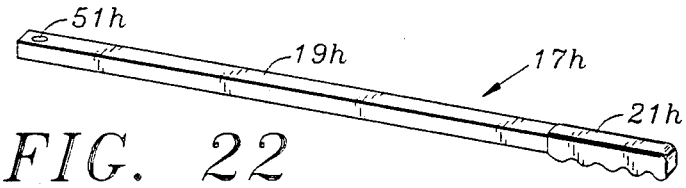
FIG. 22 is a perspective view of a handle or prybar utilized in the positioning of the drums during installation of the device of FIG. 21.

With particular reference to FIG. 22, a pry bar 17*h* comprises an elongate prying member 19*h* and a handle 21*h*. It may be utilized to jockey or manipulate the drums 100 during the installation process in order to facilitate proper positioning of each crossed elongate member 24*h* intermediate adjacent drums 100. The pry bar 17*h* may be conveniently disposed within one of the crossed elongate members 24*h* for storage. A ball detent formed upon the distal end of the prying member 19*h* engages a complimentary aperture or female detent 53*h* formed in a elongate cross member 24*h* to lock the pry bar 17*h* therein.

The crossed elongate members 24*h* and the short elongate members 12*h* are preferably formed of metal, e.g., steel or aluminum. Those skilled in the art will recognize that various other materials are likewise suitable.

Figure 25:
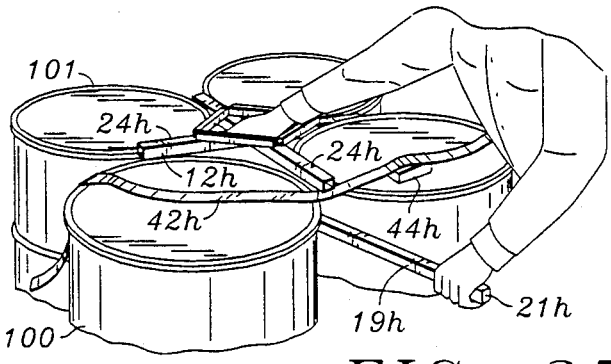
FIG. 25 is a perspective view of the device of FIGS. 21-24 being installed intermediate four drums.

With particular reference to FIG. 25, installation of the eighth embodiment of the drum holding device of the present invention is illustrated. The drum holding device is installed by first placing the four drums in side-by-side, two-by-two relationship upon a pallet and positioning one of the elongate crossed members 24*h* intermediate two adjacent drums 100, utilizing the pry bar 17, if necessary. The remaining elongate crossed members 24*h* may then be positioned intermediate adjacent drums by utilizing the pry bar 17*h* to separate adjacent drums 100, as necessary. The angle brackets 14*h*, wire support 31*h*, or plate, or other members may be utilized to support the drum holding device during the installation process.

Figure 26:
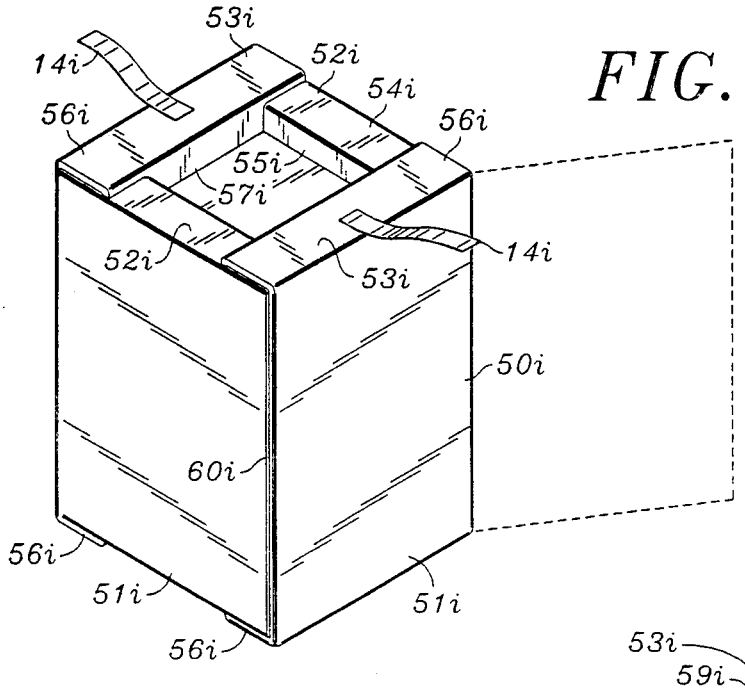
FIG. 26 is a perspective view of a disposable, e.g., cardboard, substantially rigid core member in accordance with an alternative embodiment of the present invention.
Figure 27:
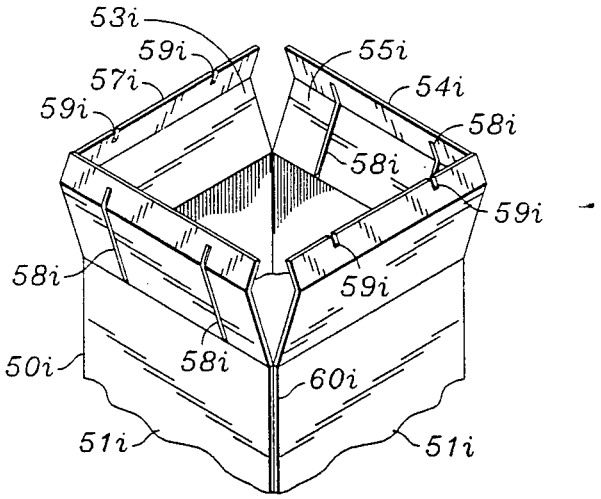
FIG. 27 is a perspective view of the upper end of the substantially rigid core member of FIG. 26 showing the upper flaps thereof in an unfolded position.
Figure 28:
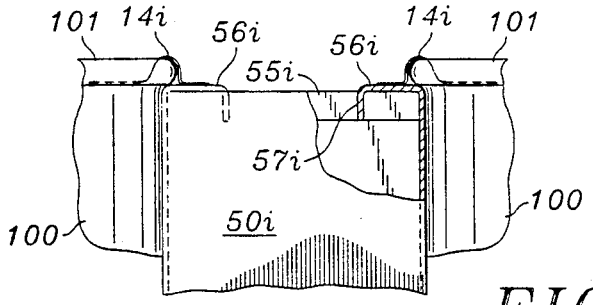
FIG. 28 is a sectional sideview, partially a cross-section, showing the disposable core member positioned intermediate two drums and hanging from tape hangers.

Referring now to FIGS. 26–28, a ninth embodiment of the drum holding device of the present invention is illustrated. The ninth embodiment of the drum holding device comprises a disposable, substantially rigid, folded structure, preferably fabricated from cardboard, fiberboard, plastic laminated paperboard, or the like. Those skilled in the art will recognize that various other inexpensive foldable structural materials are likewise suitable. The foldable material is formed into a box-like structure sized and configured to be positioned intermediate the four drums of a quartet so as to maintain the proper positioning thereof.

The ninth embodiment of the drum holding device of the present invention generally comprises four side members 51*i* defining an elongate body 50*i* having four foldable flaps formed upon either end thereof. Foldable straps 52*i* comprise horizontal planar members 54*i* and vertical planar members 55*i* and fold inwardly. Foldable flaps 53*i* similarly comprise horizontal planar members 56*i* and vertical planar members 57*i*. Slots 58*i* in the lower foldable members 52*i* receive portions of upper foldable portions 53*i*. Slots 59*i* formed in the vertical planar members 57*i* of the upper foldable members 53*i* engage and receive corresponding portions of the vertical planar members 55*i* of the lower foldable flaps 52*i*. Similar foldable flaps 52*i* and 53*i* are formed upon both the upper and lower ends of the body 50*i* to add structural strength thereto and to provide the box-like configuration thereof.

A plurality, preferably two, tape hangers 14*i* extend from the upper foldable flaps 53*i* to facilitate attachment to the upper surfaces of diametrically opposed drums 100.

With particular reference to FIG. 28, the ninth embodiment of the drum holding device of the present invention is utilized by positioning it intermediate the four drums of a quartet disposed upon a pallet and attaching the taped hangers 14*i* to the upper surfaces of the drums 100 such that the body 50*i* of the drum holding device is disposed at a desired height, i.e., appropriately centered. The drums can then be banded or clamped together as in the other embodiments of the present invention.

Additionally, in any embodiment of the present invention and particularly as shown on FIG. 26, optional separator panels may be attached to and extend outwardly from the core member 10 to form bulkheads or cushioning separators between the individual drums or containers in which the core member 10 is positioned. Such optional separator panels (dotted lines on FIG. 26) may comprise sheets of cardboard or other relatively soft material which will serve to separate the individual containers or drums and prevent the containers or drums from rubbing against one another during movement or transport. Such optional separator panels will thus serve to prevent scratching or marring of the drums and will particularly prevent inadvertant tearing or obliteration of paper or stick-on labels which have been applied to the containers or drums. In the foldable cardboard embodiment of the invention shown in FIGS. 26–28, the optional separator panels (dotted lines) may be formed contiguous with and extend outwardly from the corners or edges of the core member 10 so as to be deployable directly between the individual drums or containers of the group.

Those skilled in the art will recognize that the holding means of the present invention may be utilized to securely hold a wide variety of items together such that they may be manipulated or handled as a unit and therefore conveniently and safely transported and stored. Thus, various items such as drums 100, bottles, etc. may be placed upon a pallet or the like and moved, typically via a forklift, without the concern that one or more of the items may separate from the remaining items and fall from the pallet.

The core member of the drum holding devices of the present invention may be constructed of any suitable, substantially rigid material. Less expensive materials, i.e., plastic, fiberboard, cardboard, paperboard, or wood, may be utilized in disposable versions of the drum holding device of the present invention. More expensive and durable materials, i.e. metal, may be utilized in reusable versions of the drum holding device of the present invention. Those skilled in the art will recognize that various other materials are likewise suitable for use in the fabrication of the core member as well.

The pressure exerting member or strap utilized with any of the embodiments described and illustrated may be connected to the spacer or core member via straps or the like as in the fourth embodiment of the present invention. Such connection of the strap or pressure exerting member to the core member facilitates ease of use by partially supporting the strap or pressure exerting member during the installation process and also keeps all of the components of the drum holding device of the present invention together during storage and transportation when not in use.

It is understood that the exemplary drum holding devices described herein and shown in the drawings represent only presently preferred embodiments of the invention. Indeed, various modifications and additions may be made to such embodiments without departing from the spirit and scope of the invention. For example, the hooks of the first embodiment of the drum holding device of the present invention need not comprise planar brackets formed in a Z configuration as described and illustrated. Rather, the hooks may comprise any configuration which positions the abutment member portion(s) of the core member 10 at the desired location by engaging or resting against one or more of the drums.

Also, the core member of the third embodiment of the drum holding device of the present invention need not be uniform in any cross-section taken along its height, but rather may vary in width, diameter, or configuration, to accommodate the configuration of various drums and other items. Furthermore, the separation member 32*d* of the fourth embodiment of the drum holding device of the present invention need not be generally configured as a block as illustrated in FIGS. 6 and 7, but rather may be of any configuration which is disposable intermediate the drums such that the drums are maintained at desired positions when the clamping member or strap 42*d* is tightened. Thus, these and other modifications and additions may be obvious to those skilled in the art and may be implemented to adapt the present invention for use in a variety of different applications.

What is claimed is:

1. A system for holding a plurality of drums in substantially fixed position relative to one another while said drums are standing on a generally horizontal underlying support surface, said system comprising:

a) a core member disposed between said drums, said core member being sized and configured such that, when said drums are held in firm abutting contact with said core member, said drums will be held in substantially fixed position relative to one another while standing on said underlying support surface; and b) a pressure exerting member attached to said core member and positionable about said drums to hold said drums in firm abutting contact with said core member.

2. The system of claim 1 wherein said core member comprises:

a rigid abutment body insertable between said drums; said abutment body having a plurality of generally arcuate cut-out regions formed therein, said cut-out regions being sized and configured to conform to the size and configuration of said drums such that when said drums are forced in abutting contact with said abutment member, said drums will be seated within said cut-out regions.

3. The system of claim 1 wherein said core member comprises:

a rigid abutment member insertable between said drums; and at least one positioning member attached to and extending from said abutment member, said positioning member being configured to engage at least one of said drums in a manner that limits the extend to which said abutment member may drop vertically downward between said drums.

4. The system of claim 3 wherein said positioning member comprises a of bracket attached to and extending from said abutment member.

5. The system of claim 4 wherein said brackets are configured and positioned to abut against the tops of said drums when said abutment member is operatively inserted between said drums, thereby preventing said abutment member from dropping further vertically downward between said drums.

6. The system of claim 3 wherein said positioning member is adjustable to varying heights above said abutment member to accommodate drums of differing height.

7. The system of claim 3 wherein said positioning member comprises a flat plate member having an upper surface and a bottom surface, said abutment member being attached to and extending downwardly from the bottom surface of said plate member such that, when said abutment member is inserted between said drums, said plate member will rest on top of said drums, thereby preventing said abutment member from undergoing further vertical movement between said drums.

8. The system of claim 1 wherein said drums have annular vertically extending lips formed around the upper edges thereof and wherein said at least one positioning member comprises at least one hook attached to and extending from said abutment member, said hook being sized and configured to hook over the lip of at least one drum when said abutment member is inserted between said drums, thereby preventing said abutment member from undergoing further downward vertical movement between said drums.

9. The system of claim 1 wherein said pressure exerting member comprises at least one strap passable around said drums and tightenable therearound to exert inward pressure against said drums, thereby holding said drums in firm abutting contact with said core member.

10. The system of claim 9 wherein said at least one strap member is further provided with a tightening mechanism thereon to effect tightening of said strap member about said drums.

11. The system of claim 10 wherein said tightening mechanism comprises a ratchet.

12. The system of claim 12 wherein said pressure exerting member is unattached to said core member.

13. The system of claim 12 wherein said pressure exerting member comprises a strap positioned around said drums and tightened to pull said drums inwardly against said core member.

14. The system of claim 12 wherein said pressure exerting member comprises a band positioned around said drums and tightened to pull said drums inwardly against said core member.

15. The system of claim 12 wherein said pressure exerting member comprises a metal band positioned around said drums and tightened to pull said drums inwardly against said core member.

16. The system of cliam 12 wherein said pressure exerting member comprises a plastic band positioned around said drums and tightened to pull said drums inwardly against said core member.

17. The system of claim 1 wherein said core member is formed of wood.

18. The system of claim 1 wherein said core member is formed of structural cardboard.

19. The system of claim 1 wherein said core member is formed of metal.

20. The system of claim 1 wherein said core member is formed of structural cardboard and is initially disposed in a flat collapsed configuration and is subsequently expandable to a three-dimensional operative configuration.

21. The system of claim 1 wherein said core member comprises:

an upper abutment member; and at least one lower abutment member connected to and positioned below said first upper abutment member.

22. The system of claim 21 said lower abutment member(s) differ in configuration relative to said first abutment member.

23. The system of claim 21 wherein said lower abutment member(s) differ in size relative to said first abutment member.

24. The system of claim 1 wherein said plurality of drums comprise drums having angularly tapered sidewalls and wherein said core member is of generally conical configuration to abut against said tapered sidewalls of said drums.

25. The system of claim 1 wherein said plurality of drums comprise drums having angularly tapered sidewalls and wherein said core member is of generally frustoconical configuration to abut against said tapered sidewalls of said drums.

26. A device for stabilizing a quartet of four drums positioned in two-by-two, side-by-side relationship, while said drums are standing on a generally horizontal underlying support surface, said device comprising:

a) a core member, said core member comprising first and second elongate cross-members positioned in crossed relationship to one another, said first and second cross-members being positionable amidst said drums such that each said cross-member is in tangency to each of said four drums;

b) at least one strap member attached to said core member and deployable about said drums to hold said drums in firm abutting tangential contact with said first and second cross-members.

27. The device of claim 26 further comprising:

a tightening apparatus for tightening said strap member around said drums.

28. The device of claim 26 wherein at least one of said elongate cross-members has a hollow bore formed therein and wherein said device further comprises:

a pry bar member slideably insertable into, and stowable within the hollow bore of said at least one of said cross-members, said pry bar member being volitionally extractable from its stowed position within said hollow bore and useable to pry said drums apart when positioning said cross-members amidst said drums.

29. The device of claim 26 wherein said core member further comprises:

a support member connected to said core member, said support member being sized, configured and positioned so as to rest on top of at least one of said drums when first and second cross-members of said core member have been operatively positioned amidst said drums.

* * * * *